United States Patent [19]

Ishii

[11] 4,373,610

[45] Feb. 15, 1983

[54] SPEED CONTROL APPARATUS FOR ELEVATOR

[75] Inventor: Toshiaki Ishii, Inazawa, Japan

[73] Assignee: Mitsubishi Denki Kabushiki Kaisha, Tokyo, Japan

[21] Appl. No.: 264,167

[22] Filed: May 15, 1981

[30] Foreign Application Priority Data

May 28, 1980 [JP] Japan ..... 55-71267

[51] Int. Cl.[3] ..... B66B 1/30

[52] U.S. Cl. ..... 187/29 R

[58] Field of Search ..... 187/29

[56] References Cited

U.S. PATENT DOCUMENTS 3,741,348 6/1973 Caputo ..... 187/29
3,917,029 11/1975 Maynard ..... 187/29
3,921,046 11/1975 Anzai et al. ..... 187/29 X
3,938,624 2/1976 Maynard ..... 187/29
3,941,214 3/1976 Young et al. ..... 187/29

*Primary Examiner*—J. V. Truhe
*Assistant Examiner*—W. E. Duncanson, Jr.
*Attorney, Agent, or Firm*—Sughrue, Mion, Zinn, Macpeak & Seas

[57] ABSTRACT

A speed control apparatus for an elevator wherein a current command signal for controlling the firing angle of dual thyristor converters is supplied through a filter circuit. On switching from one converter to the other pursuant to reversing the elevator direction, the filter circuit is reset to bring the current command signal momentarily to zero, after which it rises smoothly in a positive or negative direction together with the elevator motor armature current.

6 Claims, 6 Drawing Figures

FIG. 1
PRIOR ART
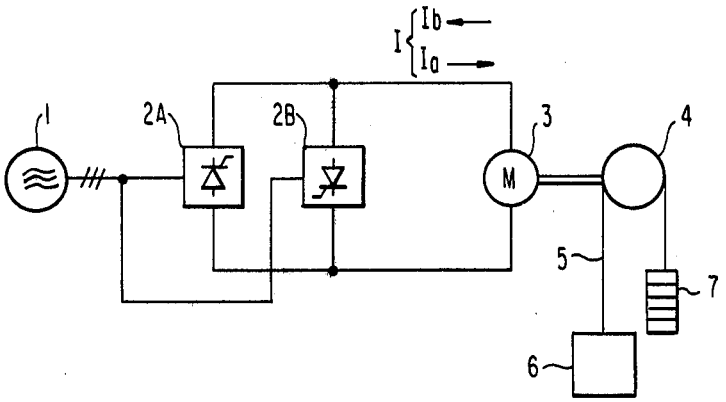
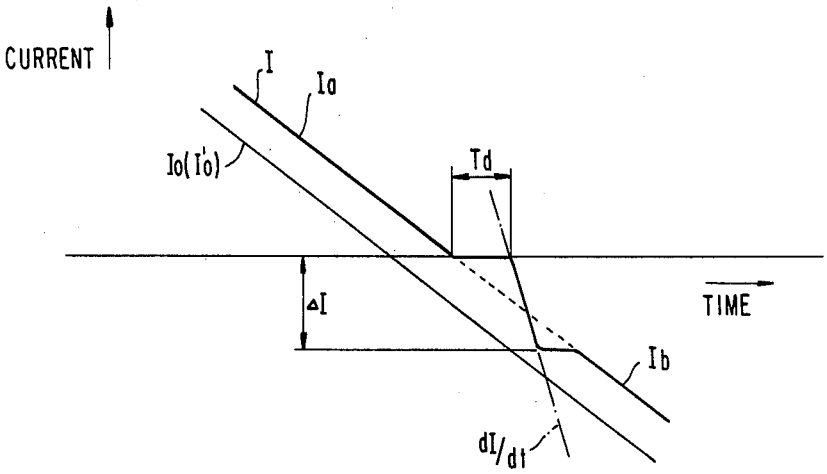
FIG. 2
PRIOR ART

SPEED CONTROL APPARATUS FOR ELEVATOR

BACKGROUND OF THE INVENTION

1. Field of the Invention

This invention relates to an apparatus for controlling the speed of an elevator by means of a non-circulating, reversible, static Leonard device.

2. Description of the Prior Art

A conventional apparatus is shown in FIG. 1, and includes dual thyristor converters 2A and 2B connected in parallel reverse and coupled to the output of a 3-phase A.C. power source 1. The armature 3 of a reversible D.C. motor M is connected to the output of the converters and drives a traction sheave 4. A cable 5 is reaved on the sheave and has an elevator car 6 attached to one end and a balancing weight 7 attached to the other end.

The firing angles of the thyristor converters 2A and 2B are controlled in accordance with a current command signal Io shown in FIG. 2, as is well known, whereby the voltage applied to the armature 3 is appropriately varied and the rotational speed of the D.C. motor is correspondingly controlled.

In this prior art apparatus, switching is effected from converter 2A to converter 2B in order to change the direction of the armature current I from Ia to Ib. When this happens a transient period Td is necessary for the switching operation to be reliably achieved without any interference between the converters. The armature current I does not flow during this period Td, which is thus called dead time. After the switching period Td the current Ib begins to flow, and as shown in FIG. 2 it has a very steep initial rise, as is well known in the art.

This steep armature current rise causes an undesirable mechanical shock which is transmitted to the elevator passengers. The severity of the shock depends on the magnitude of the armature current change $\Delta I$ as it rises, and on the rate of increase dI/dt of the armature current Ib.

SUMMARY OF THE INVENTION

This invention thus provides a speed control apparatus for an elevator which produces no mechanical shock to disturb passengers in the elevator car, by suppressing any steep variation in the D.C. motor current when switching between the dual thyristor converters constituting the non-circulating, reversible, static Leonard device. This is accomplished by providing a selector circuit which produces a selection signal for switching between the converters to reverse the direction of current flow through the D.C. motor, and a signal generating circuit which produces a signal in response to the selection signal. A current command circuit changes a current command signal based on the difference between the actual and commanded speeds of the elevator car, and momentarily brings its output to zero in response to a signal from the generating circuit. A firing angle control circuit generates a signal for triggering the thyristors on the basis of the difference between the changed current command signal and the detected current flowing in the D.C. motor.

BRIEF DESCRIPTION OF THE DRAWINGS

FIG. 1 shows a block diagram of a prior art speed control apparatus for an elevator employing a reversible static Leonard device where current does not circulate between the dual thyristor converters, FIG. 2 shows wave forms of the armature current I and a current command signal Io of the apparatus shown in FIG. 1.

DETAILED DESCRIPTION OF THE PREFERRED EMBODIMENTS

Figure 3:
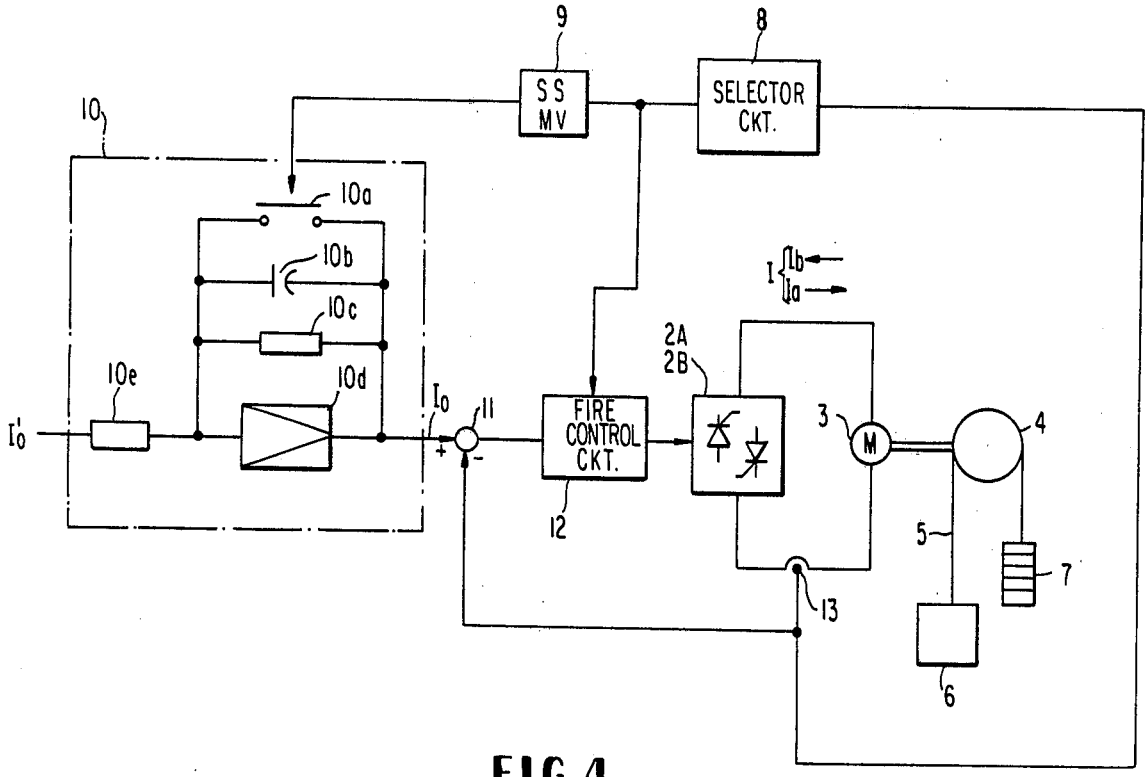
FIG. 3 shows a block diagram of an elevator speed control apparatus according to an embodiment of this invention.

Referring to FIG. 3, a single shot multivibrator 9 and a firing control circuit 12 are connected to the output of a selector circuit 8 which generates a signal **8*a* (FIG. 4B) for the operational switching of dual thyristor converters 2A and 2B. The selector circuit 8 is connected to a motor armature current detector 13, and determines the time at which switching between the converters should take place. The selector circuit 8 and the firing control circuit 12** are known per se, and are described in greater detail in U.S. Pat. Nos. 3,713,011 and 3,713,012.

The multivibrator 9 generates a pulse signal **9*a* (FIG. 4C) of predetermined width when the selection signal 8*a*** changes, and may comprise IC SN74LS123 produced by Texas Instruments.

A current command value changing circuit 10, which constitutes a first order lag circuit, is connected to the output of the multivibrator 9. The circuit 10 comprises a contact **10*a* which closes upon receiving a pulse signal 9*a* from the multivibrator, a parallel capacitor 10*b* and resistor 10*c* which together with the contact 10*a* form a filter circuit, an amplifier 10*d*, and an input resistor 10*e*. The contact 10*a*** may comprise a field-effect transistor.

An adder 11 receives the outputs from both the current command value changing circuit 10 and the current detector 13. The firing control circuit 12 is connected between the adder 11 and the converters 2A and 2B; it receives the selection signal **8*a*** and the output of the adder, and supplies the required one of the dual thyristor converters with an appropriately timed firing signal.

The pulse width of the multivibrator output signal **9*a* is initially established in accordance with the time constant of the filter circuit comprising capacitor 10*b* and the parallel combination of resistor 10*c* and the line and internal resistance of the path including contact 10*a*. The three-phase A.C. power source for the converters is not shown in FIG. 3** in the interest of simplicity.

In operation, a current command signal I'o (FIG. 4A) corresponding to the difference between a speed command signal and a signal proportional to the actual speed of the elevator car 6 is supplied to the value changing circuit 10, which generates a new current command signal Io at its output. The filter circuit is operable during this period as the contact **10*a* is open. The new command signal Io is compared with the output of the current detector 13 in the adder 11, and the resulting difference signal is supplied to the firing control circuit 12. The appropriate one of the dual thyristor converters is thus triggered, and the motor armature current is established to thereby control the speed of the elevator car 6**.

Figure 4:
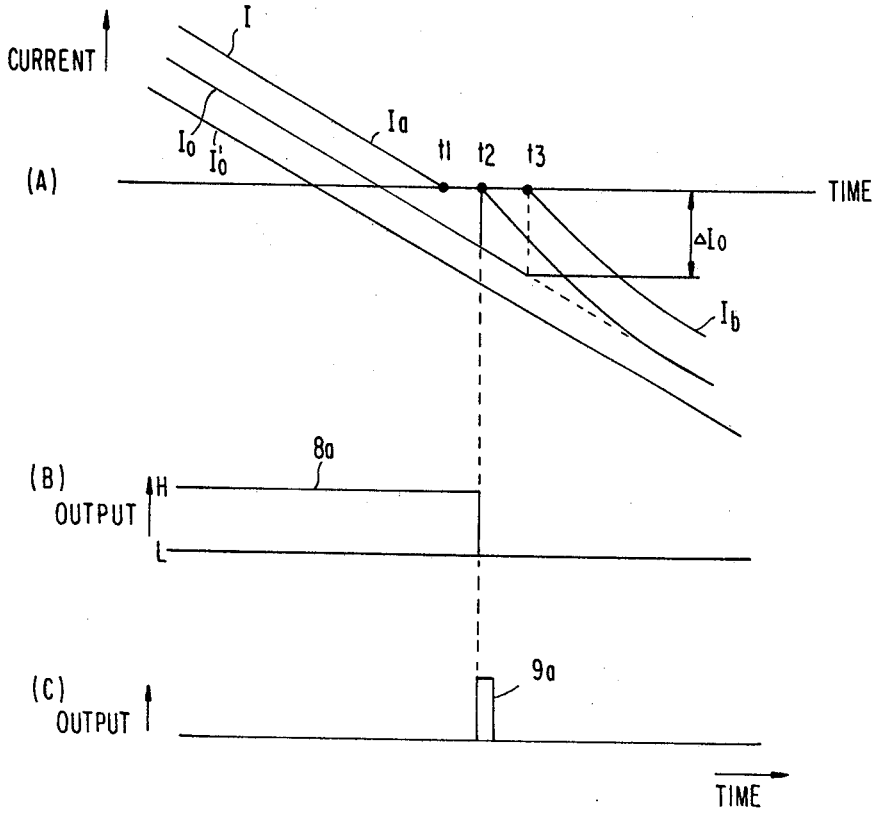
FIGS. 4A, 4B and 4C show wave forms of the armature current I, the current command signal Io, and control signals of the apparatus shown in FIG. 3.

As shown in FIG. 4A, when the armature current I decreases to zero at time $t_1$ in accordance with the current command signal Io, the switching operation between the converters begins. The selector circuit 8 changes its output level from H to L at time $t_2$ in response to the output of the current detector 13. The multivibrator 9 then generates pulse signal 9*a*, which momentarily closes contact 10*a* to short capacitor 10*b* and reset the filter. Accordingly, the current command signal Io returns to zero at time $t_2$, after which it increases smoothly in the negative direction in accordance with the time constant determined by the capacitor 10*b* and resistor 10*c*. Since the armature current I correspondingly increases smoothly in the Ib direction in accordance with the current command signal Io, the rate of increase of the armature current dI/dt is small and the elevator car passengers are not subjected to any severe mechanical shock or discomfort.

Figure 5:
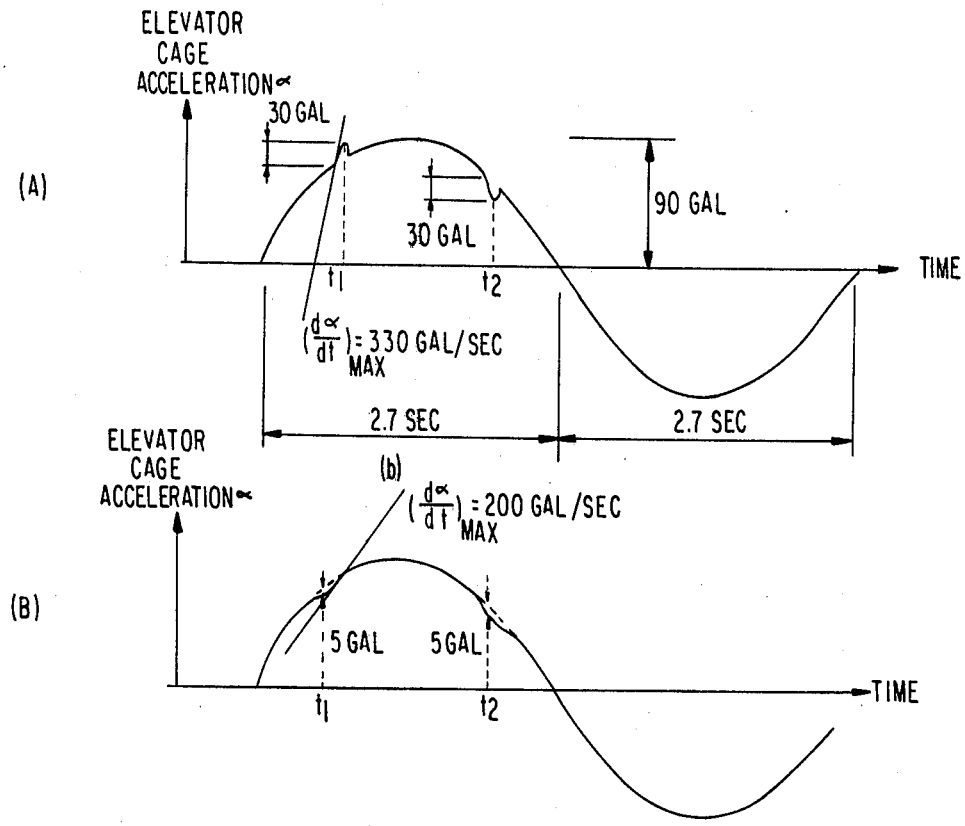
FIG. 5A shows a curve of the relation between time and acceleration inside the elevator car with the prior art apparatus.
FIG. 5B shows a similar curve resulting from the present invention.

The results of a comparative test are shown in FIG. 5. With the prior art apparatus represented by FIG. 5A, the acceleration deviates about 30 gal. (cms. per sec.$^2$) from a smooth curve at the switching times $t_1$ and $t_2$, with the maximum rate of acceleration change $d\alpha/dt$ being about 330 gal./sec. With the apparatus of this invention, on the other hand, as shown in FIG. 5B, the acceleration deviates only about 5 gal. at the switching times $t_1$ and $t_2$, and the maximum rate of acceleration change $d\alpha/dt$ drops to about 200 gal./sec.

Even if the switching time Td is slightly increased, the shock or acceleration deviation can be suppressed by making the rate of armature current increase dI/dt small.

In the description of the prior art, it was explained that the mechanical shock felt by passengers in the car depends upon the magnitude of the armature current change ΔI, and upon its rate of change dI/dt. Consequently, there are two methods of suppressing such shock, to wit:

(i) Reducing ΔI by shortening the switching time period Td, and (ii) Reducing the armature current rate of change dI/dt.

The former approach is difficult from the point of view of the technology involved, and shortening the time period Td jeopardizes reliable switching between the two converters. This invention thus takes the latter approach, and suppresses mechanical shock without restricting the switching time period Td.

Figure 6:
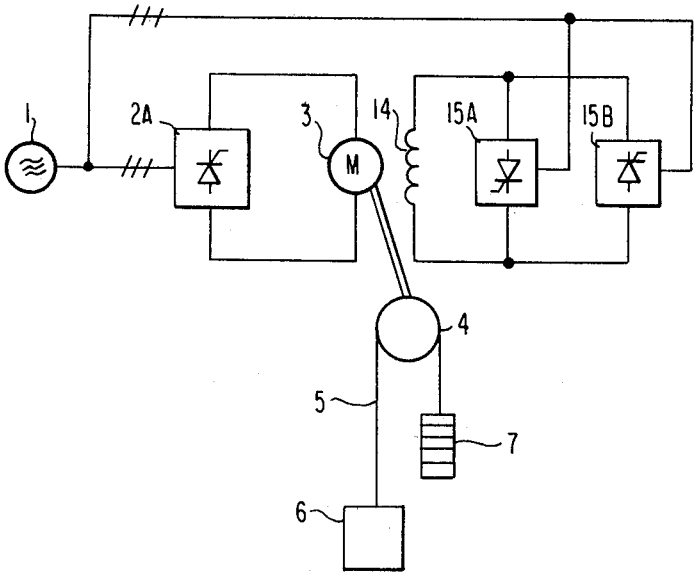
FIG. 6 shows a block diagram of a further embodiment of this invention.

In the embodiment described above the converters 2A and 2B are connected to the motor armature 3. This invention can also be applied to an arrangement as shown in FIG. 6, where the current of a field winding 14 is controlled. Specifically, dual thyristor converters 15A and 15B are connected to the motor field winding 14, and the field current command signal corresponds to the armature current command signal Io produced in FIG. 3. In the apparatus of FIG. 6 the components of FIG. 3 from the selection circuit 8 through the current detector 13 would be coupled to and control the converters 15A, 15B supplying the field winding 14 of the D.C. motor M.

What is claimed is:

1. A speed control apparatus for an elevator comprising: dual thyristor converters for converting A.C. electrical power into D.C. electrical power supplied to a D.C. motor driving an elevator car, said converters forming a non-circulating static Leonard device, a selector circuit (8) for producing a selection signal for switching between said dual thyristor converters to reverse the direction of current flowing to said D.C. motor, a signal generating circuit (9) for producing a signal in response to said selection signal, a current command changing circuit (10) for changing a current command signal based on the difference between a speed command signal for said elevator car and a signal proportional to the actual speed of said car in response to a signal from said signal generating circuit, and a firing angle control circuit (12) for generating a signal for controlling the firing angle of the converter thyristors as a function of the difference between a signal from said current command changing circuit and a detected current value of said D.C. motor, and a selection signal from said selector circuit, said current command changing circuit comprising an amplifier, and a filter circuit connected across said amplifier and formed by a resistor, a capacitor and resetting means connected in parallel, said resetting means functioning to reset said filter circuit in response to a signal from said signal generating circuit, said current command changing circuit serving to initially reduce the difference between the actual and commanded motor currents during transient switching periods of operation, and to thereafter limit the rate of change of said commanded motor current, and said signal generating circuit comprising a single pulse generator for producing a signal whose width is proportional to a time constant determined by the resistance and capacitance of said filter circuit, and which is of sufficient duration to enable the discharge of said capacitor.

2. A speed control apparatus as claimed in claim 1, wherein said means for resetting said filter circuit comprises a contact which shorts said capacitor in response to a signal from said signal generating circuit.

3. A speed control apparatus as claimed in claim 1, wherein said single pulse generator comprises a single shot multivibrator.

4. A speed control apparatus as claimed in claim 2, wherein said contact comprises a field-effect transistor.

5. A speed control apparatus as claimed in any one of claims 1, 2 or 4, wherein the static Leonard device controls the armature current of the D.C. motor.

6. A speed control apparatus as claimed in any one of claims 1, 2 or 4, wherein the static Leonard device controls the field current of the D.C. motor.

* * * * *